US006093369A

United States Patent [19]

Hall, Jr. et al.

[11] Patent Number: 6,093,369

[45] Date of Patent: Jul. 25, 2000

[54] MODIFIED NICKEL-CHROMIUM-ALUMINUM-IRON ALLOY

[75] Inventors: Bertie Forrest Hall, Jr., Ann Arbor; Stanley James Valykeo, Pinckney, both of Mich.

[73] Assignee: Hoskins Manufacturing Company, Detroit, Mich.

[21] Appl. No.: 09/138,484

[22] Filed: Aug. 24, 1998

Related U.S. Application Data

[63] Continuation-in-part of application No. 08/225,471, Apr. 8, 1994.

[51] Int. Cl.[7] ..... C22C 19/05; C22F 1/00

[52] U.S. Cl. ..... 420/443; 420/445; 148/428; 148/675

[58] Field of Search ..... 420/443, 445, 420/452; 148/428, 675

[56] References Cited

U.S. PATENT DOCUMENTS

| | | |
|---|---|---|
| 2,515,185 | 7/1950 | Bieber et al. . |
| 4,460,542 | 7/1984 | Herchenroeder . |
| 4,671,931 | 6/1987 | Herchenroeder et al. . |

FOREIGN PATENT DOCUMENTS

| | | |
|---|---|---|
| 59-85836 | 5/1984 | Japan . |

OTHER PUBLICATIONS

Microstructural Evaluation of Nickel–Based Samples From Hoskins Manufacturing Company, by V.K. Sikka dated Mar. 1988.

"Standard Test Method for Accelerated Life of Nickel-Chromium and Nickel–Chromium–Iron Alloys for Electrical Heating," American Socidty for Resting and Materials (Jul. 1990).

*Primary Examiner*—Deborah Yee

*Attorney, Agent, or Firm*—Brooks & Kushman P.C.

[57] ABSTRACT

An oxidation-resistant alloy for use in a high-temperature or thermal cycling environment. The alloy comprises a nickel-based matrix having a solid solution of 19–23% chromium and 3–6% aluminum. A self-healing, thermodynamically stable oxide layer is formed upon a surface of the alloy which is exposed to an oxidizing atmosphere over a range of temperatures for extended periods of time. The oxide layer protects the alloy from the oxidizing atmosphere. Additions of calcium and yttrium are made to the matrix to substantially remove or stabilize oxygen and sulfur dissolved in the molten alloy. These additions result in retention of about 0.005–0.05% of calcium and 0.01–0.06% yttrium in the cast alloy. The matrix further includes about 2–8% iron to inhibit nucleation and growth of a "gamma prime" nickel aluminum intermetallic compound which would otherwise adversely harden the alloy and cause local disturbance of a uniform distribution of aluminum. The alloy has a VHN below about 350.

16 Claims, 1 Drawing Sheet

MODIFIED NICKEL-CHROMIUM-ALUMINUM-IRON ALLOY

CROSS-REFERENCE TO RELATED APPLICATION

This application is a continuation-in-part of U.S. Ser. No. 08/225,471, filed Apr. 8, 1994, which is incorporated herein by reference.

TECHNICAL FIELD

The present invention relates to nickel-chromium-aluminum-iron alloys and, in particular, to such alloys which are modified with controlled quantities of yttrium and calcium.

BACKGROUND ART

Nickel-chromium-iron alloys are used primarily for their oxidation resistance and strength at elevated temperatures. Such alloys may be used, for example, as sheathing for electric heating elements and thermocouples.

Electrical resistance alloys are found in instruments and control equipment to measure and regulate electrical characteristics and in furnaces and appliances to generate heat. In the latter applications, elevated temperature characteristics are of prime importance. In common commercial terminology, electrical resistance alloys used for generation of heat are referred to as resistance heating alloys.

Resistance heating alloys such as CHROMEL-A®(80 Ni; 20 Cr) are used in many varied applications—from small household appliances to large industrial furnaces. In appliances, resistance heating elements are designed for intermittent, short-term service at about 100 to 1090° C. (about 212 to 2000° F.). In industrial furnaces, elements must often operate continuously at temperatures as high as 1300° C. (2350° F.); as high as 1700° C. (3100° F.) for kilns used for firing ceramics; and occasionally as high as 2000° C. (3600° F.) for special applications.

The primary requirements of materials used for heating elements are high melting point, high electrical resistivity, reproducible temperature coefficient of resistance, good oxidation resistance in furnace environments, absence of volatile components, and resistance to contamination. Other desirable properties are elevated temperature creep strength, high emissivity, low thermal expansion and lower modulus (both of which help minimize thermal fatigue), resistance to thermal shock, and strength and ductility or workability at fabrication temperatures.

It is known that nickel-chromium-iron compositions are ductile alloys and thus are workable. They play an important role in heaters for the higher temperature ranges. Such heaters are constructed to provide more effective mechanical support for the heating element.

Oxidation resistance of nickel-chromium alloys at elevated temperatures is weakened by the limited adherence of an initial protective oxide layer to the base metal. The ability of an alloy to survive long exposures of 2000° F. and above in air depends in large part on this protective layer remaining intact. Alloys presently used for electrical heating elements are made with carefully controlled techniques of melting, refinement and fabrication to maximize performance. However, variations in chemistry that occur between melts lead to differences in performance, as measured, for example, by accelerated life tests.

Various theories have been suggested to explain why some melts may show substantial improvement over the average performance. However, there has not been positive confirmation of any theory that has led to predictable improvement in life test results and consistently reproducible performance.

Illustrative of certain nickel-based chrome-iron-aluminum alloys are those disclosed in JP 59-85836. Such alloys, however, have a VHN above 500, which is antithetical to workability.

U.S. Pat. No. 2,515,185 relates to nickel alloys, and more particularly to age hardenable nickel alloys. Such alloys, however, do not exhibit the requisite ductility. Nor does this patent envision the use of elements which promotes oxidation resistance of the nickel alloys. In addition, the precipitation of particles of secondary phases that promote hardening will adversely affect the resistivity of the base alloy, making it less desirable as an electrical heating element.

U.S. Pat. No. 4,460,542, which is incorporated herein by reference, calls for the addition of yttrium to a chromium-aluminum-iron alloy which exhibits resistance to oxidation at high temperatures. However, this alloy only requires 14–18% chromium. U.S. Pat. No. 4,671,931 abandons the concept of yttrium additions.

DISCLOSURE OF THE INVENTION

It is accordingly an object of the present invention to provide a modified nickel-chromium-aluminum-iron alloy having superior resistance to oxidation at elevated temperatures.

It is additionally an object of the present invention to provide such an alloy which is characterized also by its workability.

The invention relates to an oxidation-resistant alloy for use in a high temperature or a thermal cycling environment. The alloy is relatively readily workable as it has a VHN below about 350. The alloy has a nickel-based matrix including 19–23 % chromium, 3–6 % aluminum, and 2–8% iron. All percentages herein are expressed as percent by weight unless otherwise specified. If a nickel-aluminum intermetallic compound, such as $Ni_3Al$ were precipitated (an ordered FCC compound referred to as "gamma prime"), the alloy would become strengthened (i.e. workability is lessened), a property which is antithetical to ductility.

To remove or stabilize oxygen and sulfur dissolved in the alloy, additions of carefully controlled quantities of calcium and yttrium are made to the melt so that about 0.005–0.05%, and preferably about 0.005–0.025% of calcium and about 0.01–0.06%, and preferably about 0.02–0.06% of yttrium are present in the cast metal ingots. These residual dissolved elements enable the aluminum in the fabricated alloy to combine with oxygen in the environment to form a means for healing a thermodynamically stable oxide scale if the layer is damaged or spalls during thermal cycling.

BEST MODE(S) FOR CARRYING OUT THE INVENTION

The alloy of the present invention is an oxidation-resistant alloy for use in a high temperature, or thermal cycling environment that is relatively soft (having a Vickers hardness (hereinafter VHN) below about 500, and preferably below 350 for malleability) workable at room temperature. The alloy has a nickel-based matrix, including, by weight, about 19–23 chromium and about 3–6 aluminum. Also present is about 2–8, and preferably about 2–3 iron for inhibiting nucleation and growth of nickel aluminum intermetallic compounds which would otherwise adversely harden the alloy and cause local disturbance of a uniform distribution of aluminum.

The alloy also includes about 0.005–0.05, and preferably about 0.005–0.025 calcium and about 0.01–0.06, and preferably about 0.02–0.06 yttrium for stabilizing oxygen or sulfur dissolved in the alloy, while retaining some calcium and yttrium in solid solution. As a result, the aluminum in the alloy may combine with oxygen in the environment to form a self-healing means for repairing a thermodynamically stable oxide layer if it becomes damaged or spalls in use.

There is thus formed a self-healing, thermodynamically stable oxide layer disposed upon a surface of the alloy which is exposed to an oxidizing atmosphere over a range of temperatures for extended periods of time. The stable oxide layer protects the alloy from the oxidizing atmosphere.

Aluminum is added for oxidation resistance. Its favorable resistance to oxidation renders the alloy suitable for use in ceramic kilns and heat treating furnaces.

1. Comparison of Processing Steps With JP 59-85836

Following is a side-by-side comparison of the respective processing steps used in JP 59-85836 and those adopted by the inventors of the present application:

TABLE 1

Figure 2:
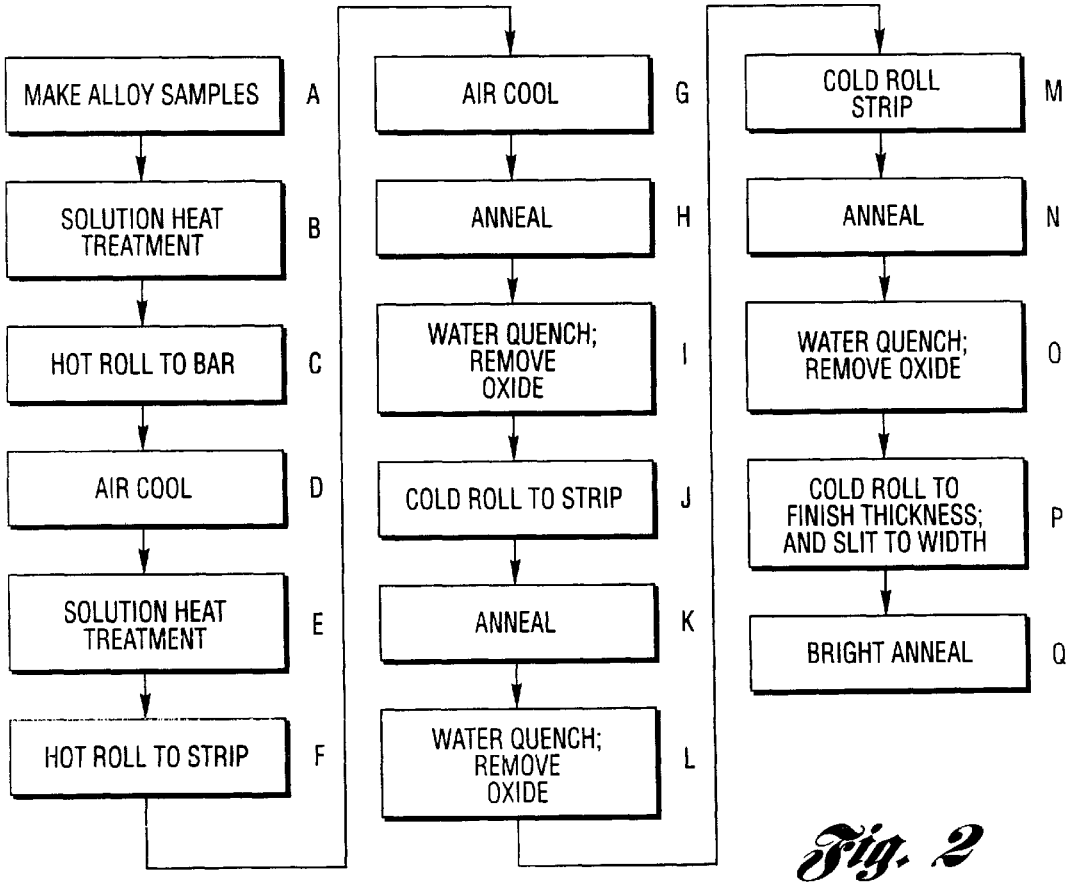
FIG. 2 depicts the steps for processing the alloy of the present invention.

| Step (See FIG. 2) | Japanese Method [JP 59-85836] | Hoskins Method [Invention] |
|---|---|---|
| A | Make alloy samples | Make alloy samples |
| B | Solution heat treatment [2 hr; air; 1200° C. (2192° F.)] | Solution heat treatment [about 3–12 hr; air; 2200° F.] |
| C | | Hot roll to bar |
| D | Cool | Air Cool |
| E | Age heat treatment [2 hr; air; 650° C. (1202° F.)] | Solution Heat treatment [about 2–12 hr; air; 2300° F.] |
| F | | Hot roll to strip |
| G | Air cool | Air cool |
| H | | Annealed 1 hour; air; 2100° F. |

TABLE 1-continued

| Step (See FIG. 2) | Japanese Method [JP 59-85836] | Hoskins Method [Invention] |
|---|---|---|
| I | | Water quenched; remove oxide to clean metal surface |
| J | | Cold roll to strip |
| K | | Annealed 1 hour; air; 2100° F. |
| L | | Water quenched; remove oxide to clean metal surface |
| M | | Cold roll to strip |
| N | | Anneal |
| O | | Water quenched; remove oxide to clean metal surface |
| P | | Cold roll to finish thickness; slit to width |
| Q | | Bright annealing 1800° F. or higher |

It is believed that the differences in the processing steps of the present invention with respect to the processing steps disclosed in JP 59-85836 are at least partly responsible for the alloys of the present invention having a VHN (below about 350) which is substantially lower than the VHN attained by the alloys of JP 59-85836 (above about 500).

2. Comparative Testing

The following experiments show that the wrought material produced by the inventors according to the chemistry specified in the tables below has a hardness below the VHN of 500 after following the solutioning and aging treatment outlined in JP 59-85836.

3. Effect of Solution and Aging Treatment On Hardness In the As-Cast Condition

To evaluate the effect of solution and aging treatment on the hardness of the disclosed alloys in the as-cast condition, several melts were prepared having the compositions set forth in Table 2 below:

TABLE 2

Chemistry Compositions (Wt. %) for Alloy in Study

| Melt No. | C | S | Al | Si | Ca | Cr | Fe | Ni | Y | Zr |
|---|---|---|---|---|---|---|---|---|---|---|
| 21427 | .005 | .0009 | 3.77 | .07 | .022 | 20.02 | 7.53 | 68.54 | .04 | <.01 |
| 21428 | .006 | .0010 | 3.73 | .08 | .001 | 20.25 | 5.18 | 70.71 | .04 | <.01 |
| 22158 | .006 | .0011 | 3.69 | .08 | .011 | 19.89 | 2.43 | 73.80 | .05 | .04 |
| 22159 | .005 | .0005 | 3.84 | .04 | .003 | 19.22 | 2.53 | 74.30 | .02 | .04 |
| 22161 | .005 | .0010 | 3.67 | .08 | .006 | 19.93 | 2.46 | 73.78 | .02 | .05 |
| 22282 | .006 | .0011 | 3.74 | .06 | .008 | 20.20 | 2.45 | 73.45 | .04 | .05 |
| 22283 | .013 | .0010 | 3.76 | .08 | .011 | 20.33 | 2.44 | 73.28 | .04 | .05 |

Table 3 illustrates the VHN of the as-cast material before solution treatment:

TABLE 3

VHN of As-Cast Material Prior to Solution Treatment (1 kg Load Applied for 20 Seconds)

| Melt No. | Trial #1 (VH) | Trial #2 (VH) | Trial #3 (VH) | Average (VH) |
|---|---|---|---|---|
| 21427-1 | 281 | 231 | 270 | 261 |
| 21427-2 | 258 | 241 | 278 | 259 |
| 21428-1 | 282 | 253 | 293 | 276 |
| 21428-2 | 304 | 313 | 311 | 309 |
| 22158-1 | 291 | 297 | 251 | 280 |
| 22158-2 | 243 | 296 | 267 | 269 |
| 22159-1 | 291 | 378* | 314 | 303 |
| 22159-2 | 291 | 288 | 288 | 289 |
| 22161-1 | 303 | 290 | 304 | 299 |

TABLE 3-continued

| VHN of As-Cast Material Prior to Solution Treatment (1 kg Load Applied for 20 Seconds) | | | | |
|---|---|---|---|---|
| Melt No. | Trial #1 (VH) | Trial #2 (VH) | Trial #3 (VH) | Average (VH) |
| 22161-2 | 283 | 276 | 292 | 284 |
| 22282-1 | 267 | 269 | 267 | 268 |
| 22282-2 | 264 | 264 | 267 | 265 |
| 22283-1 | 266 | 276 | 270 | 271 |
| 22283-2 | 296 | 311 | 296 | 301 |

*- indicates a test result which was deemed to be erroneous and was not included in the calculations The samples identified with a "1" following the heat numbers were air-cooled following the solution treatment (2 hours at 1200° C.). Table 4 details the hardness results obtained for each of these samples.

TABLE 4

| VHN of Material Air-Cooled Following a 2 Hour Solution Treatment at 1200° C. (1 kg Load Applied for 20 Seconds) | | | | |
|---|---|---|---|---|
| Melt No. | Trial #1 (VH) | Trial #2 (VH) | Average (VH) | Difference from As-Cast (ΔVH) |
| 21427-1 | 253 | 240 | 247 | −14 |
| 21428-1 | 241 | 251 | 246 | −30 |
| 22158-1 | 236 | 212 | 224 | −56 |
| 22159-1 | 257 | 240 | 249 | −54 |
| 22161-1 | 233 | 223 | 228 | −71 |
| 22282-1 | 223 | 227 | 225 | −43 |
| 22283-1 | 240 | 244 | 242 | −29 |

The samples identified with a "2" following the heat numbers were water quenched following the solutioning treatment (2 hours at 1200° C.).

Table 5 details the hardness results obtained for each of these samples. The water-quench step produces material that is markedly softer than the air-cooled material. This indicates the probable formation of a second phase in the alloy at slower cooling rates.

TABLE 5

| VHN of Material Water Quenched Following a 2 Hour Solution Treatment at 1200° C. (1 kg Load Applied for 20 Seconds) | | | | |
|---|---|---|---|---|
| Melt No. | Trial #1 (VH) | Trial #2 (VH) | Average (VH) | Difference from As-Cast (ΔVH) |
| 21427-2 | 183 | 190 | 187 | −73 |
| 21428-2 | 176 | 179 | 178 | −132 |
| 22158-2 | 185 | 177 | 181 | −88 |
| 22159-2 | 179 | 184 | 182 | −108 |
| 22161-2 | 168 | 176 | 172 | −112 |

TABLE 5-continued

| VHN of Material Water Quenched Following a 2 Hour Solution Treatment at 1200° C. (1 kg Load Applied for 20 Seconds) | | | | |
|---|---|---|---|---|
| Melt No. | Trial #1 (VH) | Trial #2 (VH) | Average (VH) | Difference from As-Cast (ΔVH) |
| 22282-2 | 167 | 130 | 149 | −117 |
| 22283-2 | 185 | 176 | 181 | −121 |

Table 6 details the hardness results obtained for each of the samples following the aging treatment (5 hours at 650° C. and then air-cooled). Recall that after the initial solution treatment the samples followed by a "1" were air-cooled and the samples followed by a "2" were water quenched. The results show very little change in hardness from the as-cast condition. There also appears to be no correlation between the cooling rate after solution treatment and the hardness after aging.

TABLE 6

| VHN of As-Cast Material After Aging Treatment (1 kg Load Applied for 20 Seconds) | | | | | |
|---|---|---|---|---|---|
| Melt No. | Trial #1 (VH) | Trial #2 (VH) | Trial #3 (VH) | Average (VH) | Difference from As-Cast (ΔVH) |
| 21427-1 | 232 | 251 | 251 | 245 | −16 |
| 21427-2 | 262 | 260 | 251 | 258 | −1 |
| 21428-1 | 299 | 268 | 233 | 267 | −9 |
| 21428-2 | 250 | 258 | 233 | 247 | −62 |
| 22158-1 | 266 | 241 | 269 | 259 | −21 |
| 22158-2 | 250 | 246 | 260 | 252 | −17 |
| 22159-1 | 300 | 284 | 313 | 299 | −4 |
| 22159-2 | 243 | 238 | 265 | 249 | −40 |
| 22161-1 | 275 | 294 | 297 | 289 | −10 |
| 22161-2 | 269 | 248 | 247 | 255 | −29 |
| 22282-1 | 284 | 277 | 272 | 278 | 10 |
| 22282-2 | 249 | 276 | 242 | 256 | −9 |
| 22283-1 | 303 | 315 | 269 | 296 | 25 |
| 22283-2 | 216 | 258 | 240 | 238 | −63 |

The results of the above studies show that the as-cast material the inventors produce as described in the appended claims has a VHN significantly lower than about 350—after following the solutioning and aging treatment outlined in JP 59-85836.

4. Effect of Solution and Aging Treatment on Hardness in the Wrought Condition

In the following study, three samples (Melt Nos. 22230, 22273 and 22283) were air induction melted, cast into ingots and hot rolled to strip. The strip was annealed one hour in air at 2100° followed by oxide removal to yield a clean metal surface. One sample (22270) was processed in the same manner as the above-mentioned three samples except that it has not yet been annealed in air.

Following is the chemistry composition for each of the heats used in this study.

TABLE 7

| Chemistry Compositions (Wt. %) for Alloy 126 Melts in Study | | | | | | | | | | |
|---|---|---|---|---|---|---|---|---|---|---|
| Melt No. | C | S | Al | Si | Ca | Cr | Fe | NI | Y | Zr |
| 22230 | .007 | .0007 | 3.89 | .03 | .001 | 20.27 | 2.49 | 73.27 | <.01 | .04 |
| 22270 | .016 | .0011 | 3.58 | .08 | .001 | 19.96 | 2.47 | 73.81 | .04 | .04 |
| 22273 | .011 | .0010 | 3.72 | .09 | .007 | 20.32 | 2.48 | 73.27 | .04 | .06 |
| 22283 | .013 | .0010 | 3.76 | .08 | .011 | 20.33 | 2.44 | 73.28 | .04 | .05 |

Table 8 details the hardness results obtained for each of the samples in the hot worked condition prior to the solution treatment. Note the significantly higher hardness of the samples from heat 22270, presumably due to the fact that those samples had not been annealed.

TABLE 8

| Initial VHN Of Hot Rolled Material Prior To Solution Treatment (1 kg Load Applied for 20 Seconds) | | | |
|---|---|---|---|
| Melt No. | Trial #1 (VH) | Trial #2 (VH) | Average (VH) |
| 22230-1 | 297 | 297 | 297 |
| 22230-2 | 297 | 297 | 297 |
| 22270-1 | 386 | 413 | 400 |
| 22270-2 | 388 | 380 | 374 |
| 22273-1 | 289 | 291 | 290 |
| 22273-2 | 255 | 258 | 257 |
| 22283-1 | 278 | 288 | 283 |
| 22283-2 | 266 | 269 | 268 |

The samples identified with a "1" following the heat numbers were air-cooled following the solution treatment (2 hours at 1200° C.).

Table 9 details the hardness results obtained for each of these samples. Note the fact that the hardness value for 22270-1 has fallen in line with the other three samples, indicating an effective reduction of residual stresses has taken place during the solution treatment for that sample.

TABLE 9

| VHN of Material Air-Cooled Following a 2 Hour Solution Treatment at 1200°0 C. (1 kg Load Applied for 20 Seconds) | | | | |
|---|---|---|---|---|
| Melt No. | Trial #1 (VH) | Trial #2 (VH) | Average (VH) | Difference from Initial (ΔVH) |
| 22230-1 | 258 | 276 | 267 | −30 |
| 22270-1 | 268 | 258 | 263 | −137 |
| 22273-1 | 276 | 269 | 273 | −17 |
| 22283-1 | 265 | 276 | 271 | −12 |

The samples identified with a "2" following the heat numbers were water quenched following the solution treatment (2 hours at 1200° C.).

Table 10 details the hardness results obtained for each of these samples. The water-quench produces material that is markedly softer than the air-cooled material. This indicates the probable formation of a second phase in the alloy at slower cooling rates. Again note that the VHN value for 22270-2 is now comparable with the other samples.

TABLE 10

| VHN of Material Water Quenched Following a 2 Hour Solution Treatment at 1200° C. (1 kg Load Applied for 20 Seconds) | | | | |
|---|---|---|---|---|
| Melt No. | Trial #1 (VH) | Trial #2 (VH) | Average (VH) | Difference from Initial (ΔVH) |
| 22230-2 | 199 | 199 | 199 | −98 |
| 22270-2 | 194 | 193 | 194 | −180 |
| 22273-2 | 204 | 203 | 204 | −53 |
| 22283-2 | 227 | 218 | 223 | −45 |

Table 11 details the hardness results obtained for each of the samples following the aging treatment (5 hours at 650° C. and then air-cooled). Recall that after the initial solution treatment the samples followed by a "1" were air-cooled and the samples followed by a "2" were water quenched. The results show very little change in hardness from the initial hot-worked condition (except in the case of 22270, which had not been annealed). There also appears to be no correlation between the cooling rate after solution treatment and the hardness after aging.

TABLE 11

| VHN of Hot Rolled Material After Aging Treatment (1 kg Load Applied for 20 Seconds) | | | | | |
|---|---|---|---|---|---|
| Melt No. | Trial #1 (VH) | Trial #2 (VH) | Trial #3 (VH) | Average (VH) | Difference from As-Cast (ΔVH) |
| 22230-1 | 300 | 288 | 296 | 295 | −2 |
| 22230-2 | 267 | 262 | 258 | 262 | −35 |
| 22270-1 | 274 | 288 | 265 | 276 | −124 |
| 22270-2 | 236 | 239 | 245 | 240 | −134 |
| 22273-1 | 278 | 286 | 269 | 278 | −12 |
| 22273-2 | 280 | 271 | 285 | 272 | +15 |
| 22283-1 | 285 | 340 | 317 | 314 | +31 |
| 22283-2 | 254 | 258 | 263 | 258 | −10 |

Again, the results of the study show that the wrought material prepared according to the disclosed regimen having the composition described in the appended claims has a hardness well below a hardness of about 350 following the solution treatment and aging treatment outlined in JP 59-85836.

5. Effect of Solution and Aging Treatment On The Hardness of Alloy Compositions Outside The Claimed Ranges In The As-Cast And Wrought Condition The significance of the claimed ranges of chemical composition are disclosed in the following study which illustrate the effect of solution and aging treatment on the hardness of alloy compositions falling outside the claimed range.

6. Effect of Solution and Aging Treatment On The Hardness of Compositions Falling Outside The Claimed Aluminum Ranges In The As-Cast and Wrought Conditions The earlier studies revealed that alloys falling within the claimed range do not produce material with a VHN of about 350 or more after the solutioning and aging treatment at the temperatures and times detailed in JP 59-85836.

Selected compositions were produced by weighing up to 10 pound charges and melting them. Foundry and rolled samples were prepared. Foundry samples were analyzed for chemical composition and sectioned to prepare samples which represent the as-cast condition for study. The rolled samples were used to produce hot-work material to study the wrought condition of the compositions.

A. Procedure

1) Two charges of the inventive alloy were weighed up and melted in a 10-pound induction furnace. Foundry samples (approximately 1.25"ϕ×8") and rolling samples (cast into Pyrex tubes approximately 0.409"ϕ×6") were obtained for each of the heats.
2) The foundry samples were sectioned and prepared for chemical analysis. In addition, two samples were obtained by sectioning a wafer into nearly equal half-circle disks approximately 0.25" thick. Two of these samples were obtained from each of the heats. The samples were identified using an engraver to avoid loss of identity.
3) The rolling samples were heated to 2000° F. and rotary swaged from 0.409"ϕ to 0.326"ϕ. The samples were then sectioned to obtain wafers approximately 0.25" thick. Two of these samples were obtained from each of the heats. The samples were identified using an engraver to avoid loss of identity.
4) A VHN test was performed on each of the samples.
5) The samples were placed in a furnace at 1200° C. (2192° F.) for 2 hours.
6) One cast sample and one wrought sample from each of the heats was water quenched. The other samples from each of the heats were air-cooled.
7) A VHN test was performed on each of the samples.
8) The samples were placed in a furnace at 650° C. (1202° F.) for 5 hours.
9) The samples were removed from the furnace and allowed to air cool.
10) A VHN test was performed on each of the samples.

B. Discussion of Results

Table 12 provides the analyzed chemistry composition for both of the heats used in the study.

TABLE 12

| Charge Aims And Chemistry Compositions (Wt. %) | | | | | | | | | | |
|---|---|---|---|---|---|---|---|---|---|---|
| Melt No. | C | S | Al | Si | Ca | Cr | Fe | Ni | Y | Zr |
| X1377 | .024 | .0015 | 6.20 | .04 | .001 | 22.57 | 2.31 | 68.82 | .001 | .03 |
| X1378 | .017 | .0014 | 6.26 | .03 | .001 | 22.76 | 7.24 | 63.66 | .001 | .03 |

Table 13 details the hardness results obtained for each of the samples prior to the solution treatment.

TABLE 13

| Initial VHN Of Material Prior To Solution Treatment (1 kg Load Applied for 20 Seconds) | | | | |
|---|---|---|---|---|
| Melt No. | Trial #1 (VH) | Trial #2 (VH) | Trial #3 (VH) | Average (ΔVH) |
| X1377-1 (Cast) | 392 | 336 | | 364 |
| X1377-2 (Cast) | 396 | 375 | | 386 |
| X1377-1 (Wrought) | 339 | 350 | 338 | 342 |
| X1377-2 (Wrought) | 308 | 307 | 315 | 310 |
| X1378-1 (Cast) | 353 | 334 | | 344 |
| X1378-2 (Cast) | 316 | 337 | | 327 |
| X1378-1 (Wrought) | 332 | 333 | 330 | 332 |
| X1378-2 (Wrought) | 330 | 338 | 336 | 335 |

The samples identified with a "1" following the heat numbers were air-cooled following the solution treatment (2 hours at 1200° C.). Table 14 details the hardness results obtained for each of these samples.

TABLE 14

| VHN Of Material Air-Cooled Following A 2 Hour Solution Treatment At 1200° C. (1 kg Load Applied for 20 Seconds) | | | | | |
|---|---|---|---|---|---|
| Melt No. | Trial #1 (VH) | Trial #2 (VH) | Trial #3 (VH) | Average (VH) | Difference from Initial (ΔVH) |
| X1377-1 (Cast) | 342 | 340 | | 341 | −23 |
| X1377-1 (Wrought) | 337 | 327 | 324 | 329 | −13 |
| X1378-1 (Cast) | 313 | 331 | | 322 | −22 |
| X1378-1 (Wrought) | 318 | 303 | 311 | 311 | −21 |

The samples identified with a "2" following the heat numbers were water quenched following the solution treatment (2 hours at 1200° C.).

Table 15 details the hardness results obtained for each of these samples. The water-quench produces material that is markedly softer than the air-cooled material.

TABLE 15

VHN Of Material Water Quenched Following A 2 Hour Solution Treatment At 1200° C. (1 kg Load Applied for 20 Seconds)

| Melt No. | Trial #1 (VH) | Trial #2 (VH) | Trial #3 (VH) | Average (VH) | Difference from Initial (ΔVH) |
|---|---|---|---|---|---|
| X1377-2 (Cast) | 337 | 324 | | 331 | −55 |
| X1377-2 (Wrought) | 267 | 263 | 267 | 266 | −44 |
| X1378-2 (Cast) | 252 | 256 | | 254 | −73 |
| X1378-2 (Wrought) | 251 | 249 | 245 | 248 | −87 |

Table 16 details the hardness results obtained for each of the samples following the aging treatment (5 hours at 650° C. and then air-cooled). Recall that after the initial solution treatment the samples followed by a "1" were air-cooled and the samples followed by a "2" were water quenched. There is a correlation between the aging treatment and hardenability in these compositions, especially in the high Al, Cr and Fe sample (X1378). In all cases, the effect was strongest on samples that were water-quenched after the solutioning treatment.

TABLE 16

VHN Of Material After Aging Treatment (1 kg Load Applied for 20 Seconds)

| Melt No. | Trial #1 (VH) | Trial #2 (VH) | Trial #3 (VH) | Trial #4 (VH) | Average (VH) | Difference from Initial (ΔVH) |
|---|---|---|---|---|---|---|
| X1377-1 (Cast) | 363 | 369 | 349 | | 360 | −4 |
| X1377-2 (Cast) | 495 | 424 | 386 | | 435 | +49 |
| X1377-1 (Wrought) | 363 | 347 | 354 | 348 | 353 | +11 |
| X1377-2 (Wrought) | 360 | 360 | 366 | | 362 | +52 |
| X1378-1 (Cast) | 340 | 351 | 353 | | 348 | +4 |
| X1378-2 (Cast) | 546 | 544 | 544 | | 545 | +218 |
| X1378-1 (Wrought) | 384 | 399 | 453 | 401 | 409 | +77 |
| X1378-2 (Wrought) | 519 | 489 | 569 | 502 | 520 | +185 |

The study shows that, for example, the composition produced in Heat X1378 (High Al, Cr, and Fe) has a VHN greater than 500 following the solution and aging treatment outlined in JP 59-85836. Only the material that was water quenched after solution treatment produced material with a VHN of at least 500.

7. Microstructural Comparison Of Alloys Of The Present Invention With Respect To Alloys Of JP 59-85836

To compare the microstructure of the alloys of the present invention to the alloys disclosed in JP 59-85836, the following five alloys were prepared:

TABLE 17

Compositions Of The Examined Alloys Elements (Wt. %)

| Alloy No. | C | S | Al | Si | Ca | Cr | Fe | Ni | Y | Zr | Ti |
|---|---|---|---|---|---|---|---|---|---|---|---|
| 22283 | 0.013 | 0.0010 | 3.76 | 0.08 | 0.011 | 20.33 | 2.44 | 73.28 | 0.04 | 0.05 | |
| X1377-2[a] | | | 6.26 | | | 22.57 | 2.30 | b | | | |
| X1378-2[a] | | | 6.26 | | | 22.76 | 7.24 | b | | | |
| 17032[c] | | | 3.95 | | | 36.5 | 8.0 | b | | | |
| 17033[d] | | | 3.96 | | | 38.5 | 5.8 | b | | | 0.65 |

[a]Other elements are assumed to be similar to alloy 22283.
b Balance
[c]Example 3 in JP 59-85836
[d]Comp. Example 2 in JP 59-85836

The 22283, X1377-2 and X1378 alloys were prepared in accordance with the present invention. Alloy 22283 is a more preferred composition of the present invention. Alloy X1377-2 has amounts of aluminum and chromium near the upper limit of the present invention. Alloy X1378-2 has amounts of aluminum, chromium and iron near the upper limits of the present invention.

All of the alloys were evaluated in the cast condition. The final heat treatment was a solution treatment for 2 hr. at 1200° C. followed by water-quenching. The quenched samples were aged for 5 hr at 650° C.

All of the samples were evaluated for their microhardness. The data are listed below in Table 18.

TABLE 18

Microhardness Data

| Alloy No. | Microhardness (HV) |
|---|---|
| 22283-1 | 272.8 ± 6.2 |
| X1377-2 | 337.8 ± 71.9 |
| X1378-2 | 518.1 ± 98.4 |
| 17032 | 656.5 ± 23.4 |
| 17033 | 653.2 ± 18.4 |

Microstructures of the alloys were examined and reported in MICROSTRUCTURAL EVALUATION OF NICKEL-BASED SAMPLES FROM HOSKINS MANUFACTURING COMPANY, by V. K. Sikka dated March 1998, which is incorporated herein by reference. The following observations are detailed in the above report.

Alloy X1378-2

This alloy shows two distinctly different phases. High-magnification scanning electron microscopy (SEM) shows the two phases to be distinctly different. The second phase has a fairly large fraction of the microstructure.

Alloy X1377-2

This alloy also shows distinct second phase, but the amount is much smaller than Alloy X1378-2.

Alloys 17032 and 17033

These alloys show second phase distributed throughout.

High-magnification SEMs of alloy X1378-2 show that the second phase has a very fine lamellar microstructure. A careful microhardness measurement (see Table 19) shows that the matrix has a hardness of 288±21 and that the lamellar phase a value of 655±9. These large differences in hardness of the phases are responsible for a very large deviation in average hardness, when no distinction between the two is made during typical VHN measurement.

TABLE 19

Selective Microhardness Data Of Various Samples

| Alloy. No. | Microhardness[a] | |
|---|---|---|
| X1377-2 | Matrix | 331 ± 4 |
| | Second phase | 540 ± 44 |
| X1378-2 | Matrix | 288 ± 21 |
| | Second phase | 655 ± 9 |
| 17032 | | 700 ± 14 |
| 17033 | | 705 ± 9 |
| 22283-1 | | 289 ± 14 |

[a]VHN at 500 g load.

SEMs micrographs of alloy X1377-2 show the presence of very fine, nearly spherical particles inside the second-phase regions. It is believed that the lamellar structure in alloy 1378-2 has changed its morphology to spherical particles in alloy X1377-2. The morphology change probably is a direct result of the difference in the iron content of the two alloys. The careful microhardness measurements of the matrix and the second-phase region in alloy X1377-2 again show the second phase to be much harder (540±44 VHN) as opposed to the matrix (331±44 VHN).

It is believed that the larger standard deviation in the hardness of the second phase in alloy X1377-2 may be due to nonuniformity in distribution of the spherical particles as opposed to perfectly aligned particles in the second phase of alloy X1378-2.

A microprobe analysis in Table 20 indicates the presence of large gamma-prime particles at the grain boundaries. It is believed that the lamellar looking microstructure is also gamma prime, but was too fine for chemical analysis. It is believed that spherical particles in alloy X1377-2 are the same as the lamellar structure in alloy 1378-2, and that they are gamma prime.

Micrographs of alloys 17032 and 17033 show fairly uniform distribution of large particles rather than distinct two phase regions observed in alloys X1377-2 and X1378-2. The repeated microhardness of alloys 17032 and 17033 gave values of 700±14 and 705±9, respectively. The uniformity of the hardness in these samples suggest that the hardening phase is uniformly distributed. Higher magnification micrographs show the presence of a very fine lamellar structure in both alloys 17032 and 17033. This lamellar structure is somehow different than the very uniformly-spaced lamellar structure in alloy X1378-2.

TABLE 20

Microprobe Analysis Summary

| Alloy No. | Phase[a] |
|---|---|
| 22283-1 | No second phase. |
| X1377-2 | No second phase. |
| X1378-2 | Grey phase[b] (56.92 Ni, 8.94 Cr, 3.54 Fe, 30.59 Al, at %) |
| 17032 | Grey phase[c] (27.16 Ni, 62.13 Cr, 7.40 Fe, 3.31 Al, at %) |
| 17033 | Grey phase[d] (21.04 Ni, 71.07 Cr, 5.12 Fe, 2.54 Al, 0.23 Ti, at %) |

[a]Key phases, when observed, were quantitatively analyzed.
[b]This composition is enriched in aluminum and is typical of gamma prime. Typically, the gamma prime is $Ni_3$(Al, Ti, Nb, Ta). It could be (Ni Cr Fe)$_3$Al.
[c]This phase is rich in chromium and very low in aluminum. Its composition matches that of alpha-chromium.
[d]This phase is very rich in chromium and very low in aluminum, and contains a small amount of titanium. Its composition matches that of alpha-chromium.

The microprobe analysis in Table 20 had shown the coarse gray particles to be alpha-chromium. It is believed that the same alpha-chromium particles that are present as finely spaced lamellar caused the large hardening observed in alloys 17032 and 17033.

The titanium addition in alloy 17033 did not seem to have a significant effect in modifying the microstructure.

Our observations of gamma-chromium hardening in alloys 17032 and 17033 are consistent with that proposed in the Japanese Patent No. 59-85836.

The nominal alloy 22283-1 did not show any features in the optical structure. Its second check of microhardness of 289+/−14 VHN is consistent essentially with a solid solution alloy.

A combination of microprobe, microhardness, optical microstructure, and high-magnification SEM analysis of five different specimens results in the following observations:

1. Alloys X1378-2 and X1377-2 consist of two phases (the matrix and the second phase). The second phase had significantly higher (655 and 540, respectively) hardness than the matrix phase (288 and 331, respectively). The second phase hardening is believed to be from very fine gamma prime. The gamma prime in the low iron content, alloy X1377-2 is typical of gamma prime (spherical particles) observed in nickel-based superalloys. However, the higher iron containing alloy X1378-2 contained gamma prime as the lamellar morphology;
2. The duplicated sample from the Japanese Patent No. 59-85836, alloys 17032 and 17033, showed large hardening from a very fine distribution of alpha-chromium particles. These results are consistent with the hardening mechanisms proposed from the Japanese Patent No. 59-85836; and
3. The standard alloy 22283 was observed to be a solid solution. No second phase was observed in this alloy.

8. Additional Examples

To further illustrate various aspects of the present invention, the following additional examples are disclosed.

Seven alloys were melted. Their chemistry, aside from impurities, is summarized in Table 21:

TABLE 21

| Alloy No. | Nominal Starting Chemical Composition[1] (Wt. %) Ni | Cr | Fe | Al | Y | Ca |
|---|---|---|---|---|---|---|
| 62-1 | Bal. | 19.71 | 0.22 | 3.78 | NA[2] | 0.0132 |
| 62-2 | Bal. | 19.55 | 2.27 | 3.73 | NA | 0.0109 |
| 62-3 | Bal. | 19.33 | 4.28 | 3.67 | NA | 0.0109 |
| 64-1 | Bal. | 20.50 | 0.15 | 4.10 | NA | 0.012 |
| 64-2 | Bal. | 20.23 | 2.30 | 4.00 | 0.012 | 0.0063 |
| 66-1 | Bal. | 19.90 | 6.00 | 4.20 | None Detected | 0.0160 |
| 66-2 | Bal. | 19.40 | 7.80 | 4.10 | 0.040 | 0.0060 |

[1]Compositions are of the solid alloy.
[2]"Not Added."

Oxidation tests were conducted at 2200° F. for 80 hours and at 2300° F. for 195 hours to compare oxidation resistance of the seven alloys.

The experimental procedure involved placing samples of the alloys in an electrically heated box furnace and exposing them to air flow created by convective thermal currents. The samples were cycled daily. After cooling to room temperature during each cycle, the specimens were examined. The results appear in Table 22:

TABLE 22

Typical Elevated Temperature Properties

| Alloy No. | Oxidation Wt. Change (Gram/Cm$^2$) | ASTM Life (Hours) |
|---|---|---|
| 62-1 | −0.00156 | 120 |
| 62-2 | −0.00153 | 212 |
| 62-3 | −0.001918 | 96 |
| 64-1 | 0.000860 | 224 |
| 64-2 | 0.000437 | 800 |
| 66-1 | 0.000112 | 444 |
| 66-2 | 0.000226 | 582 |

In Table 22, a specific weight loss is caused by spalling of the oxide scale during cycling. However, Table 22 also shows that following an effective reduction in the sulfur content by combination with calcium and/or yttrium, the alloy may exhibit a slight weight gain through the formation of a protective scale of alumina. Desulfurized specimens tend to show a positive specific weight change throughout the duration of the life test.

The right-hand column of Table 22 follows the procedure set forth in ASTM designation B76–90 standard test method (2 min. on/2 min. off) at 2150° F. for determining the accelerated life of nickel-chromium and nickel-chromium-iron alloys used for electrical heating. That publication is incorporated herein by reference.

Results obtained after 80 hours at 2200° F. and 195 hours at 2300° F. (31 cycles to room temperature) indicate that alloys such as 66-1 exhibited preferable performance because they incurred the lowest weight gain (0.000112 gm/cm$^2$). However, alloys 64-2 and 66-2, which contain yttrium, yielded the longest life (800 hours and 582 hours, respectively).

Although lifetime improvement over conventional alloys is not susceptible of easy quantification, it is likely that lifetime is increased by at least several fold.

Figure 1:
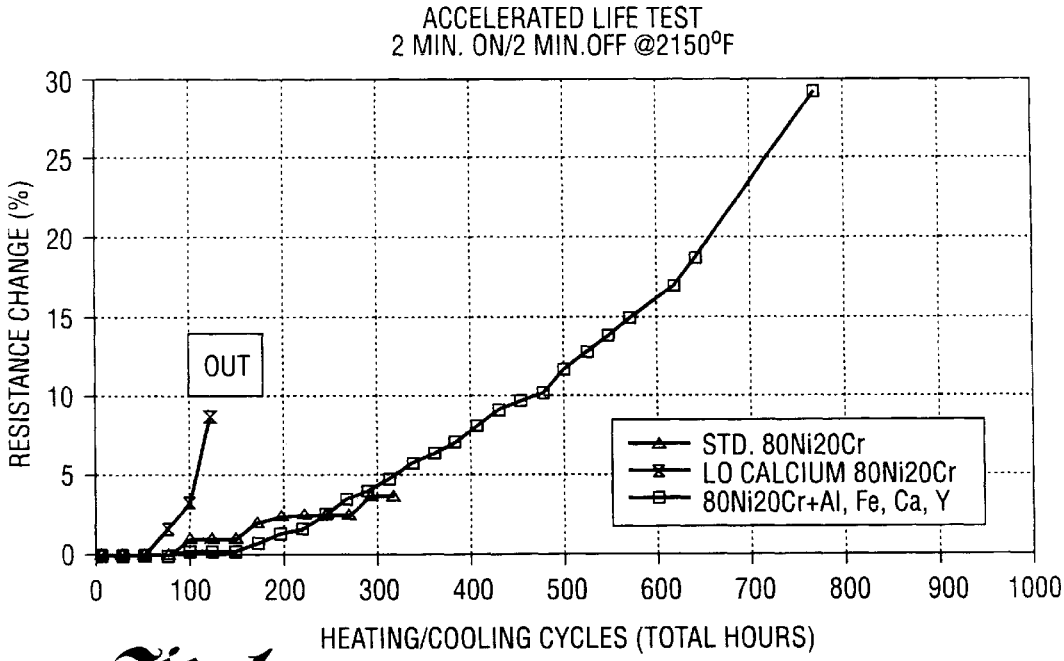
FIG. 1 depicts the results of an accelerated life test of several alloys falling within the scope of the disclosed invention, wherein resistance change is plotted as a function of cycling time.

Turning now to FIG. 1, there is depicted the results of an accelerated life test wherein resistance change (percent) is plotted against hours of cycling. The 64-2 alloy, as noted above, lasted almost 800 hours.

Table 23 summarizes the disclosed and preferred ranges of alloy composition, aside from impurities:

TABLE 23

| ELEMENT | Alloy Composition Ranges[3] (Wt. %) DISCLOSED | PREFERRED |
|---|---|---|
| Ni | Balance | Balance |
| Cr | 19–23 | 19–21 |
| Fe | 2–8 | 2–3 |
| Al | 3–6 | 3.5–4.5 |
| Ca | 0.005–0.05 | 0.005–0.025 |
| Y | 0.01–0.06 | 0.02–0.06 |

[3]Compositions are of the solid alloy.

Without wishing to be bound by any particular theory, the inventors have observed that the advanced alloys and coatings disclosed rely on the formation and adherence of a thin and continuous aluminum oxide film to protect the base alloy from further oxidation attack at elevated temperatures. In order for the alumina scale to serve its protective function, it must remain adherent to the underlying alloy under prolonged exposure and thermal cycling conditions. It is known that segregation of indigenous sulfur to the metal-oxide interface induces premature scale spalling of the scale. This may occur through a reduction in the interfacial adhesion strength, with a resulting reduction in component lifetime.

The inherent reactivity of yttrium requires an exceptionally high degree of control over alloy chemistry during melting/casting. Control of the concentration of the reactive element additions is particularly important, since retention of a minimum amount in solution in cast alloys is required to impart acceptable oxidation resistance. However, when the concentration of the reactive element greatly exceeds that of the impurities with which it reacts, the formation of extraneous, low melting point phases can result. If the proportion of the reactive element is too high or too low, the oxidation characteristics of the alloy may be suboptimal.

The inventors have discovered that by the addition of aluminum to the nickel-chromium base alloy, oxidation resistance is enhanced by the formation of an impervious layer of aluminum oxide. To ensure that the surface oxide layer remains intact with a "self-healing" mechanism if the oxide is damaged or spalls, it is necessary to have aluminum dissolved uniformly in the alloy matrix to a level of about 3–6%, and preferably about 4% by weight. At this level, it is thought that diffusion of the aluminum atoms in the matrix can occur quickly to replace aluminum depletion by alumina formation at the surface. The limited solubility of aluminum in the nickel-chromium alloy can result in precipitation of some of the aluminum in the form of a nickel-aluminum phase referred to as "gamma prime." As noted earlier, these particles can cause severe hardening in the alloy and a reduction in the aluminum in solution in the surrounding matrix.

To modulate this mechanism, iron and other metals may be added. To enhance the adherence of the surface oxide to the base metal, small additions of calcium and yttrium with other rare earth metals have been found to be effective. The results of alloying and testing show that reproducible results can be assured if the following chemistry controls are exercised:

TABLE 24

| Detailed Composition Ranges (Wt. %) | |
|---|---|
| Chromium | 19–23 |
| Aluminum | 3–6 |
| Iron | 2–8 |
| Zirconium | 0–0.10 |
| Calcium | 0.005–0.05 |
| Yttrium | 0.01–0.06 |
| Sulfur | 0–0.008 |
| Boron | 0–0.005 |
| Carbon | 0–0.03 |
| Silicon | 0–2.0 |
| Manganese | 0–0.5 |
| Titanium | 0–0.25 |
| Nickel | Balance |

The inventors have developed the disclosed alloy so that it may serve as a thermocouple sheath, tube, wire, or strip for use as a heating element or as a tubular member in applications which are exposed to an oxidizing atmosphere at high temperatures.

The disclosed alloys provide for favorable oxidation resistance at the highest temperatures of intended use without spalling of the surface oxide. Yttrium, calcium, and zirconium in the proper relative amounts effectively reduce the oxygen and sulfur content of the resulting alloy. As a result, these highly reactive additions are present uniformly in the matrix of the alloy. This ensures initial reaction of aluminum in the matrix at the hot surface with the ambient air/atmosphere and provides a base for bonding subsequent layers of aluminum oxide. The control of sulfur in the alloy by calcium and yttrium tends to neutralize the potential of this undesirable impurity to interfere with oxide layer formation.

The chemistry of the alloys disclosed requires refining the melt to neutralize the sulfur and oxygen contained in the alloy. Hot fabricability is promoted through the addition of zirconium in the disclosed amounts and sequence during melting. The precipitation of "gamma prime" is retarded by increasing the solid solubility of aluminum in the nickel-chromium base alloy. As a result, cold working processes are facilitated.

Further, the disclosed alloys promote formation of a continuous protective layer of alumina. Thus, adherence of the oxide layer to the base alloy is ensured during thermal cycling, thereby promoting longer life at higher temperatures over comparable alloys which are presently available.

It will be apparent to those skilled in the art that the novel principles of the invention disclosed herein, in connection with specific examples thereof, will support various other modifications and applications of the same. It is accordingly desired that, in construing the breadth of the appended claims, they will not be limited to the specific examples of the invention described herein.

What is claimed is:

1. An oxidation-resistant alloy for use in a high temperature oxidizing environment, the alloy consisting essentially of, in weight percent:

a nickel-based matrix including about 19–23 chromium and about 3–6 aluminum;

a self-healing thermodynamically stable oxide layer formed upon a surface of the matrix which is exposed to the oxidizing environment over a range of temperatures for extended periods of time, the layer protecting the alloy from the oxidizing environment;

about 0.005–0.05 calcium and about 0.01–0.06 yttrium for removing or stabilizing oxygen and sulphur dissolved in the matrix, thereby permitting the aluminum in the matrix to combine with oxygen in the environment to form a means for healing the layer and the surface if the layer is damaged or spalls;

about 2–8 iron for inhibiting nucleation and growth of a nickel aluminum intermetallic compound that would adversely harden the alloy and cause local disturbance of a uniform distribution of the aluminum; and a balance of impurities, the alloy after aging having a VHN below about 350.

2. The alloy of claim 1, wherein the matrix comprises about 19–21 chromium.

3. The alloy of claim 1, wherein the matrix comprises about 3.5–4.5 aluminum.

4. The alloy of claim 1, wherein the matrix comprises about 0.005–0.025 calcium.

5. The alloy of claim 1, wherein the matrix comprises about 0.02–0.06 yttrium.

6. The alloy of claim 1, wherein the matrix comprises about 2–3 iron.

7. The alloy of claim 1, wherein the matrix comprises between about 0–0.005 boron.

8. The alloy of claim 1, wherein the matrix comprises about 0.05–0.10 zirconium.

9. A thermocouple sheath consisting essentially of, in weight percent:

a nickel-based matrix including about 19–23 chromium and about 3–6 aluminum;

a self-healing thermodynamically stable oxide layer formed upon a surface of the matrix which is exposed to an oxidizing environment over a range of temperatures for extended periods of time, the layer protecting the sheath from the oxidizing environment;

about0.005–0.05 calcium and about0.01–0.06yttrium for removing or stabilizing oxygen or sulphur dissolved in the matrix, thereby permitting the aluminum in the matrix to combine with oxygen in the environment to form a means for healing the layer and the surface if the layer is damaged or spalls;

about 2–8 iron for inhibiting nucleation and growth of a nickel aluminum intermetallic compound that would adversely harden the alloy and cause local disturbance of a uniform distribution of aluminum; and a balance of impurities, the alloy having a VHN below about 350.

10. A thermocouple sheath consisting essentially of, in weight percent:

a nickel-based matrix including about 19–23 chromium and about 3–6 aluminum;

a self-healing thermal dynamically stable oxide layer formed upon a surface of the matrix which is exposed to an oxidizing environment over a range of temperatures for extended periods of time, the layer protecting the alloy from the oxidizing environment;

about 0.005–0.05 calcium and about 0.01–0.06 yttrium for removing or stabilizing oxygen or sulfur dissolved in the matrix thereby permitting the aluminum and the matrix to combine with oxygen in the environment to form a means for healing the layer and the surface if the layer is damaged or spalls;

about 2–8 iron for inhibiting nucleation and growth of a nickel aluminum intermetallic compound that would adversely harden the alloy and cause local disturbance of a uniform distribution of aluminum;

additives selected from a group consisting of zirconium (0–0.10); boron (0–0.005); carbon (0–0.25); and mixtures thereof;

the sheath having a VHN below about 350.

11. A heating element consisting essentially of, in weight percent:

a nickel-based matrix including about 19–23 chromium and about 3–6 aluminum;

a self-healing thermodynamically stable oxide layer formed upon a surface of the matrix which is exposed to an oxidizing environment over a range of temperatures for extended periods of time, the layer protecting the alloy from the oxidizing environment;

about 0.005–0.05 calcium and about 0.01–0.06 yttrium for removing or stabilizing oxygen or sulphur dissolved in the matrix, thereby permitting the aluminum in the matrix to combine with oxygen in the environment to form a means for healing the layer and the surface if the layer is damaged or spalls; and about 2–8 iron for inhibiting nucleation and growth of a nickel aluminum intermetallic compound that would adversely harden the alloy and cause local disturbance of a uniform distribution of aluminum, the heating element having the characteristic of workability in operational use;

the heating element having a VHN below about 350.

12. An alloy comprising, in weight percent:

a nickel-based matrix including about 19–23 chromium and about 3–6 aluminum;

a self-healing thermodynamically stable oxide layer formed upon a surface of the matrix which is exposed to the oxidizing environment over a range of temperatures for extended periods of time, the layer protecting the alloy from the oxidizing environment;

about 2–8 iron for inhibiting nucleation and growth of a nickel aluminum intermetallic compound that would adversely harden the alloy and cause local disturbance of a uniform distribution of the aluminum; and a balance of impurities, the alloy after aging having a VHN below about 350.

13. The alloy of claim 12, wherein the matrix comprises about 19–21 chromium.

14. The alloy of claim 13, wherein the matrix comprises about 3.5–4.5 aluminum.

15. The alloy of claim 14, wherein the matrix comprises about 2–3 iron.

16. A method of making an alloy comprising, in weight percent, a nickel-based matrix including about 19–23 chromium and about 3–6 aluminum;

a self-healing thermodynamically stable oxide layer formed upon a surface of the matrix which is exposed to the oxidizing environment over a range of temperatures for extended periods of time, the layer protecting the alloy from the oxidizing environment;

about 2–8 iron for inhibiting nucleation and growth of a nickel aluminum intermetallic compound that would adversely harden the alloy and cause local disturbance of a uniform distribution of the aluminum; and a balance of impurities, the alloy having a VHN below about 350;

said method comprising:

making the alloy sample;

subjecting the alloy sample to a first solution heat treatment;

subjecting the alloy sample to a first air cooling;

subjecting the alloy sample to a second solution heat treatment; and subjecting the alloy sample to a second air cooling.

* * * * *